US006527230B1

(12) United States Patent
Frick

(10) Patent No.: US 6,527,230 B1
(45) Date of Patent: Mar. 4, 2003

(54) TRACK RECEIVER

(75) Inventor: John S. Frick, Springdale, PA (US)

(73) Assignee: PHW Inc., East Pittsburgh, PA (US)

( * ) Notice: Subject to any disclaimer, the term of this patent is extended or adjusted under 35 U.S.C. 154(b) by 0 days.

(21) Appl. No.: 09/953,844

(22) Filed: Sep. 17, 2001

(51) Int. Cl.[7] ..... B61L 1/00
(52) U.S. Cl. ..... 246/194; 246/196
(58) Field of Search ..... 246/194, 196, 246/62, 63 A, 63 C, 63 R

(56) References Cited

U.S. PATENT DOCUMENTS 1,655,006 A * 1/1928 Zierdt ..... 246/63 R
5,501,417 A * 3/1996 Capan ..... 246/194
5,586,736 A * 12/1996 Mollet ..... 246/194
5,622,339 A * 4/1997 Capan ..... 246/194
5,628,478 A * 5/1997 McConnel et al. ..... 246/194
5,711,497 A * 1/1998 Andrianos et al. ..... 246/167 R
5,791,602 A * 8/1998 Capan ..... 246/194
5,995,881 A * 11/1999 Kull ..... 246/182 A

* cited by examiner

*Primary Examiner*—S. Joseph Morano
*Assistant Examiner*—Frantz F. Jules
(74) *Attorney, Agent, or Firm*—Webb Ziesenheim Logsdon Orkin & Hanson, P.C.

(57) ABSTRACT

A track receiver is located on-board a locomotive for receiving a first magnetic field produced in response to a cab signal carrier transmitted through a rail on which the locomotive is carried. The track receiver is oriented so that a second magnetic field produced during operation of a traction motor of the locomotive propagates substantially perpendicular to an axis of sensitivity of the track receiver, and is oriented so that the first magnetic field propagates parallel to the axis of sensitivity of the track receiver.

16 Claims, 8 Drawing Sheets

TRACK RECEIVER

BACKGROUND OF THE INVENTION

1. Field of the Invention

The present invention relates to on-board cab signaling systems and, more particularly, to the rejection of magnetic field interference imposed on inductive track receivers employed by these systems.

2. Description of the Prior Art

Cab signals are utilized extensively to communicate information to a cab signal system located on-board a locomotive. This information is utilized by the cab signal system to provide information to an operator of a locomotive or to automatically control the operation of the locomotive.

Cab signal systems typically employ inductive track receivers mounted on the locomotive ahead of the lead wheels and just above the rails for sensing and converting magnetic fields produced by cab signal carriers transmitted through the rails into cab signals. An advantage of cab signals is that information can be made available to the locomotive operator on a continuous basis. This is especially useful for communicating instantaneous changes in the status of a track circuit to operators of locomotives on the track circuit. By communicating this information on a continuous basis, locomotives can be controlled to safely proceed through the track circuit.

A prior art track receiver typically includes an iron core inductor mounted above and orthogonal to a longitudinal axis of a rail. The frequency of the cab signal carrier transmitted through the rails is typically in the range from 40 Hz to 250 Hz, but may be as high as 5 kHz. Prior art track receivers are utilized quite successfully in older model locomotives which utilize DC traction motors. Modern locomotives, however, utilize AC traction motors which receive alternating current power from an inverter. The combination of an AC traction motor and inverter provides a greater degree of speed, power and control over a DC traction motor while eliminating the high maintenance requirements associated with the use of DC traction motors.

An AC traction motor receives alternating current from the inverter at a variable frequency between 0 Hz and 300 Hz according to the speed requirement of the train. This results in the generation of an alternating current magnetic field by the AC traction motor that did not exist with DC traction motors. Since the frequency of the alternating current magnetic field generated by the AC traction motor is in the same frequency range as cab signal carriers, the AC traction motor is a primary source of noise signals which can be imposed on the track receivers along with the cab signals. Thus, the use of AC traction motors can severely compromise cab signals as a safe and reliable information source.

Various approaches for reducing the effect of the alternating current magnetic fields and, hence, noise signals produced by an AC traction motor have been proposed. One approach is disclosed in U.S. Pat. No. 5,586,736 to Mollet. The Mollet patent discloses pickup units 44 each having a housing 48 with a rectangular configuration but for a missing lower side thus forming an inverted, hollow U-shaped enclosure. An inverted U-shaped magnetic structure is received in housing 48 and is essentially centered within top and end segments 50 and 52 of housing 48. The magnetic structure includes a pair of vertical legs 54 and a horizontal cross member 56. Legs 54 and cross member 56 are formed from cylindrical ferrite rods. Each pickup unit 44 is positioned and oriented so that legs 54 extend toward the rail thereby enhancing the capacity of each pickup unit 44 to receive magnetic fields produced by the cab signal carriers. A pickup coil 58 or 60 is wound on each leg 54. Pickup coils 58 and 60 are connected so that cab signals produced by coils 58 and 60 are additive and noise signals produced by coils 58 and 60 are subtractive.

Another approach proposed in U.S. Pat. No. 5,622,339 to Capan is a pair of plate antennas for sensing the magnetic fields produced by the cab signal carrier. Each plate antenna includes a signal coil and a noise coil wound on a rectangular core at right angles to each other. The signal coils and the noise coils of the plate antennas are connected so that the outputs of the noise coils cancel any noise components in the signals output by the signal coils, such as noise components caused by the operation of the AC traction motor.

As can be seen from the Mollet and Capan patents, those skilled in the art of cab signaling systems believed it necessary for each track receiver to maintain an orthogonal relationship with the rail, to modify the shape of the track receiver, to utilize high permeability materials and/or to utilize additional windings to subtract out motor noise from the cab signal. These solutions, however, are specialized and/or costly and require application specific tuning and calibration by empirical testing. In addition, these solutions have limited capacity to completely subtract out motor noise due to mutual coupling of the signal and noise coils.

It is, therefore, an object of the present invention to overcome the above problem and others by providing a cab signaling system having an track receiver oriented to minimize the effects of magnetic field motor noise produced by a traction motor during operation while, at the same time, detecting magnetic fields produced by a cab signal carriers transmitted through the rails with an acceptable signal to noise ratio. Still other objects of the present invention will become apparent to those of ordinary skill in the art upon reading and understanding the following detailed description.

SUMMARY OF THE INVENTION

Accordingly, I have invented a system for use on a locomotive having a traction motor which generates a first magnetic field during operation. The system includes at least one track receiver located on-board the locomotive and disposed in a second magnetic field produced around at least one of a pair of rails on which the locomotive is carried in response to a cab signal carrier propagating through the at least one rail. The track receiver converts the second magnetic field into a cab signal. The track receiver is also disposed in the first magnetic field generated during operation of the traction motor of the locomotive for converting the first magnetic field into a noise signal. A cab signal system located on-board the locomotive is connected to receive the cab signal and the noise signal from the track receiver. The cab signal system is configured to extract data from the cab signal which has a frequency range at least partially in common with a frequency range of the noise signal. The first magnetic field propagates in a three dimensional space around the traction motor. The first magnetic field has at each point in the three dimensional space a magnetic vector which, with reference to a Cartesian coordinate system, is comprised of a horizontal component which extends parallel to the longitudinal axes of the rails adjacent the locomotive, a lateral component which extends laterally to the longitudinal axes of the rails adjacent the locomotive and a vertical component which extends perpendicular to the horizontal and lateral components. The track receiver is positioned on the locomotive in the three dimensional space and is oriented so that at the points in the three dimensional space where the track receiver is positioned the vector sum of at least two of the horizontal, lateral and vertical components has a direction vector substantially perpendicular to an axis of sensitivity of the track receiver where the track receiver is most sensitive to a magnetic field propagating therealong.

The track receiver is positioned on the locomotive so that a magnetic vector of the second magnetic field produced around the at least one rail propagates through the track receiver substantially parallel to the axis of sensitivity of the track receiver.

The axis of the sensitivity of the track receiver can be received in an imaginary plane which extends substantially parallel to top surfaces of the rails. The traction motor has a longitudinal axis which extends transverse to the longitudinal axes of the rails. The track receiver is positioned adjacent one of the rails and, when viewed normal to a surface of the imaginary plane, an extension of the axis of sensitivity of the track receiver crosses an extension of the longitudinal axis of the traction motor on a side of the one rail opposite the other rail. Preferably, the longitudinal axis of the traction motor extends laterally to the longitudinal axes of the rails.

When the track receiver is positioned on the locomotive and oriented so that the vector sum of two of the vertical, horizontal and lateral components, at the points in the three dimensional space where the track receiver is positioned, has a direction vector substantially perpendicular to the axis of sensitivity of the track receiver, the remaining one of the vertical, horizontal and lateral components has a direction vector substantially perpendicular to the axis of sensitivity of the track receiver.

At least one of the vertical, horizontal and lateral components can have a magnitude of zero. Preferably, the track receiver is comprised of (i) a coil of wire or (ii) a Hall-effect sensor.

Alternatively, the axis of sensitivity of the track receiver can be received in an imaginary plane which extends laterally and substantially perpendicular to the longitudinal axes of the rails. Where the traction motor has a longitudinal axis which extends transverse to the longitudinal axes of the rails and the track receiver is positioned adjacent one of the rails, when viewed normal to a surface of the imaginary plane, an extension of the axis of sensitivity of the track receiver crosses an extension of the longitudinal axis of the traction motor on a side of the one rail opposite the other rail.

I have also invented a system for use on a rail vehicle received on a pair of rails and having a traction motor which generates a magnetic field which propagates in a three dimensional space around the traction motor. The magnetic field has at each point in the three dimensional space a magnetic vector which, with reference to a Cartesian coordinate system in the three dimensional space, is comprised of the vector sum of three components which extend perpendicular to each other with one of the three perpendicular components parallel to the longitudinal axes of the rails. The system includes a track receiver positioned on-board the rail vehicle in the three dimensional space adjacent one of the rails and oriented in the three dimensional space so that at the points in the three dimensional space where the track receiver is positioned the vector sum of at least two of the three perpendicular components has a direction vector substantially perpendicular to an axis of sensitivity of the track receiver.

The system can also include another track receiver positioned on-board the rail vehicle in the three dimensional space adjacent the other rail and oriented in the three dimensional space so that at the points in the three dimensional space where the other track receiver is positioned the vector sum of at least two of the three perpendicular components has a direction vector substantially perpendicular to an axis of sensitivity of the other track receiver.

Preferably, the axis of sensitivity of each track receiver is positioned at a compound angle comprising a first angle relative to a first plane which extends parallel to top surfaces of the rails and a second angle relative to a second plane which extends laterally and perpendicular to the longitudinal axes of the rails.

The track receivers are preferably connected so that cab signals output by the track receivers in response to a cab signal carrier flowing through the rail adjacent each track receiver are additive.

Each track receiver is also oriented relative to its adjacent rail so that a magnetic vector of another magnetic field produced around the rail in response to the cab signal carrier flowing therethrough propagates through the track receiver substantially parallel to the axis of sensitivity of the track receiver.

Lastly, I have invented a cab signaling system for use on a locomotive having a traction motor positioned between a front end and a back end of the locomotive. The system includes a first track receiver disposed on-board the locomotive adjacent one of a plurality of rails which support the locomotive and in a magnetic field generated by the traction motor during operation. The first track receiver outputs a first cab signal in response to a cab signal carrier transmitted through the rail adjacent the first track receiver. The first track receiver also outputs in response to the magnetic field a first signal noise having a frequency in a frequency range of the first cab signal. The first track receiver has an axis of sensitivity which is oriented at a first position in the magnetic field substantially perpendicular to a direction vector of the magnetic field at the first position. A signal processor located on-board the locomotive is connected to receive from the first track receiver the first cab signal and the first noise signal. The signal processor is configured to process signals in the frequency range of the first cab signal. The orientation of the axis of sensitivity of the first track receiver in the magnetic field results in a ratio of the first cab signal to the first noise signal being of a sufficient extent so that the signal processor can process the first cab signal without interference by the first noise signal.

The system can also include a second track receiver disposed on-board the locomotive adjacent another one of the plurality of rails and in the magnetic field. The second track receiver outputs a second cab signal in response to transmission of the cab signal carrier through the rail adjacent the second track receiver. The second track receiver also outputs in response to the magnetic field a second noise signal having a frequency in a frequency range of the second cab signal. The second track receiver has an axis of sensitivity which is oriented at a second position in the magnetic field substantially perpendicular to a direction vector of the magnetic field at the second position. The signal processor is connected to receive from the second track receiver the second cab signal and the second noise signal and to process signals in the frequency range of the second cab signal. The orientation of the axis of sensitivity of the second track receiver in the magnetic field results in a ratio of the second cab signal to the second noise signal being of a sufficient extent so that the signal processor can process the second cab signal without interference by the second noise signal.

Preferably, the first and second track receivers are connected so that the first and second cab signals sum and the first and second noise signals sum. The orientation of the axes of sensitivity of the first and second track receivers in the magnetic field results in a ratio of the sum of the cab signals to the sum of the noise signals being of a sufficient extent so that the signal processor can process the sum of the cab signals without interference from the sum of the noise signals.

DETAILED DESCRIPTION OF THE INVENTION

The present invention will be described with reference to the accompanying drawings where like reference numbers correspond to like elements.

Figure 1A:
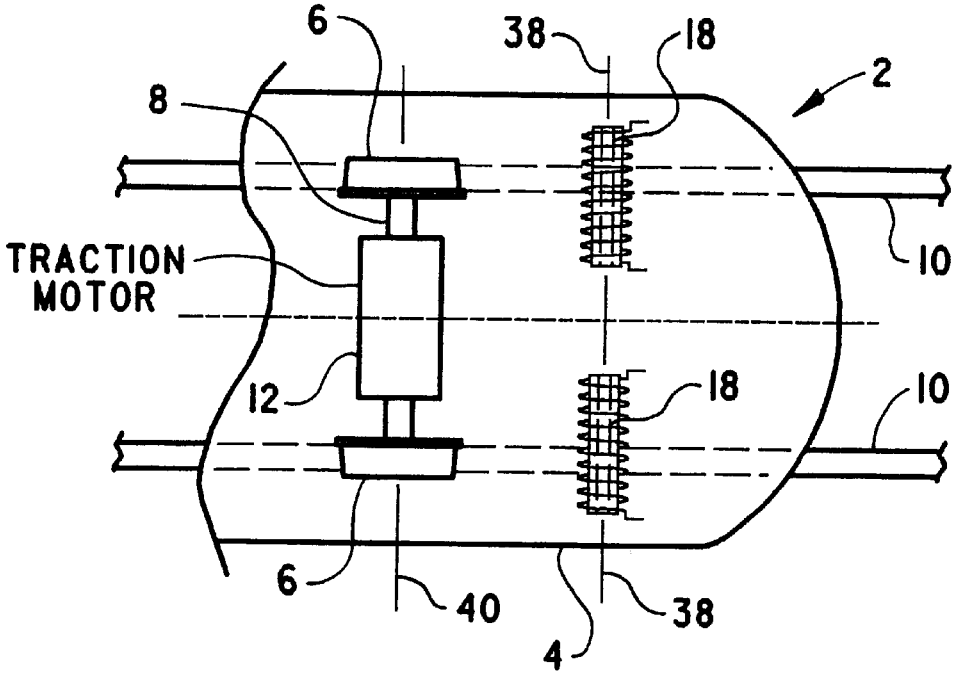
FIG. 1a PRIOR ART
FIGS. 1*a*–1*c* are fragmentary top, side and front views of a locomotive showing the lead wheels, traction motor and inductive track receivers positioned in accordance with the prior art.
Figure 1B:
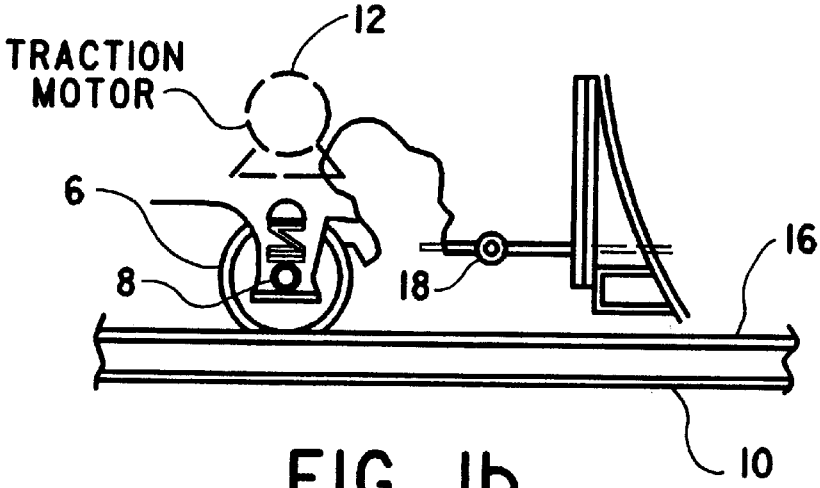
FIG. 1b PRIOR ART
Figure 1C:
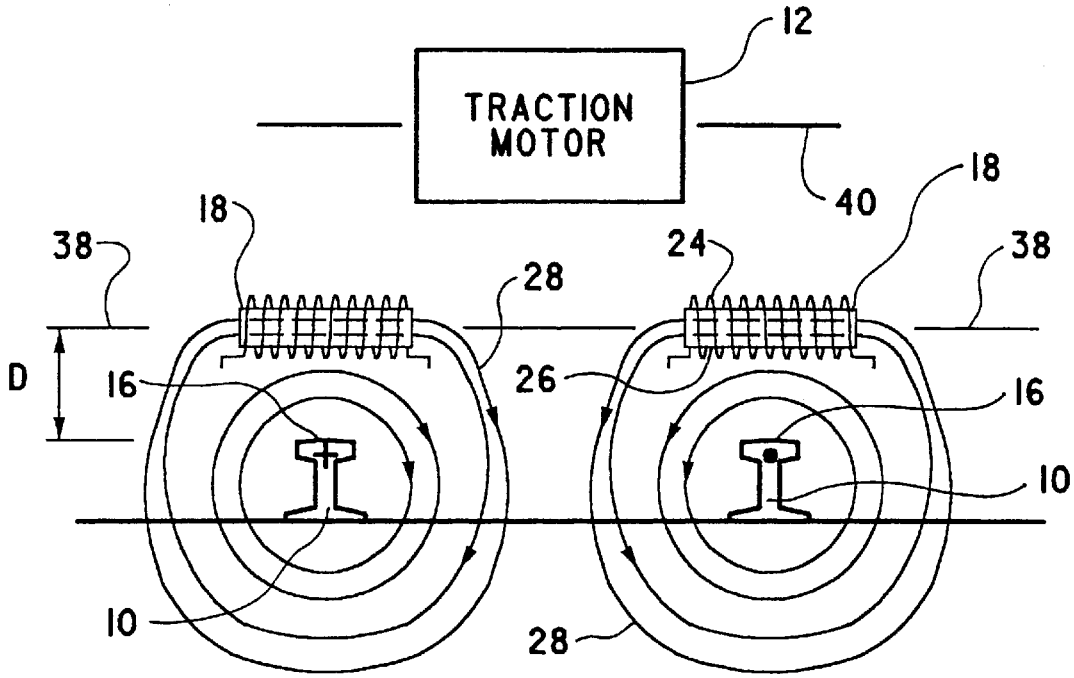
FIG. 1c PRIOR ART

With reference to FIGS. 1*a*–1*c,* a rail vehicle or locomotive 2 includes a vehicle body 4 having a plurality of wheels 6 and a plurality of axles 8 coupled to vehicle body 4 in a manner known in the art. Each axle 8 includes a wheel 6 on each end thereof. Each axle 8 fixes the position of the wheels 6 in spaced parallel relation for rolling along a pair of spaced parallel rails 10 in a manner known in the art.

Rail vehicle 2 also includes a traction motor 12 coupled between vehicle body 4 and one or more wheels 6 for propelling rail vehicle 2 along rails 10 in response to traction motor 12 receiving electrical power from a power generating means 14. When traction motor 12 is an AC traction motor, power generating means 14 is an inverter which supplies switched AC power to the AC traction motor. When traction motor 12 is a DC traction motor, power generating means 14 is a DC power supply which supplies DC power to the DC traction motor.

Connected to vehicle body 4 a distance D above a top surface 16 of each rail 10 is an inductive track receiver 18. While one track receiver 18 above one rail 10 can be utilized, a track receiver 18 above each rail 10 is preferred.

A longitudinal axis 38 of each track receiver 18 defines a single axis of sensitivity along which track receiver 18 is most sensitive to the propagation of a magnetic field vector therealong. Each track receiver 18 is positioned and oriented with its longitudinal axis 38 parallel to a magnetic field vector 28 generated around the closest adjacent rail 10 in response to a cab signal carrier transmitted therethrough. Each track receiver 18 includes an inductive coil of wire 24 wrapped around an iron core 26. However, track receiver 18 can be any device, e.g., a Hall effect sensor, having a single axis of sensitivity oriented parallel to magnetic field vector 28.

Figure 2:
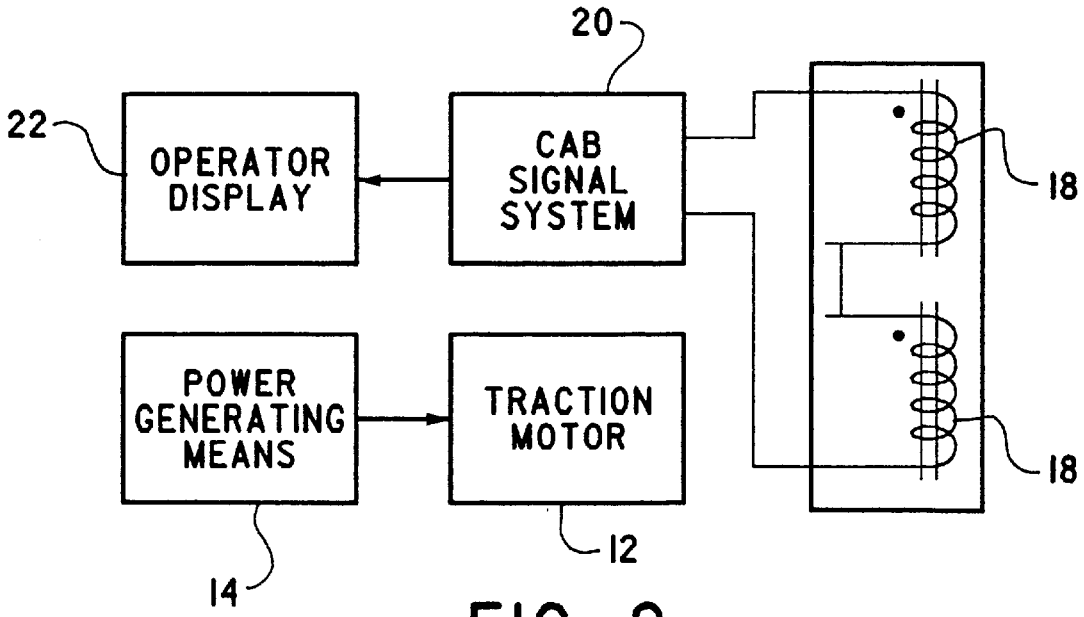
FIG. 2 is a block diagram of a cab signaling system and an operator display for receiving and processing signals output by the inductive track receivers shown in FIGS. 1*a*–1*c,* and a power generating means for supplying electrical power to the traction motor shown FIG. 1*a*–1*c;*

With reference to FIG. 2 and with continuing reference to FIGS. 1*a*–1*c,* each inductive track receiver 18 converts magnetic field vector 28 received thereby along longitudinal axis 38 into a cab signal which is supplied to a cab signal system 20 for processing. Preferably, track receivers 18 are connected so that the output of their respective coils of wire 24 are additive. Cab signal system 20 extracts data from the cab signal and supplies the extracted data to an operator display 22.

In practice, a cab signal carrier transmitted in one rail 10 in a first direction, shown by the cross (+) in the left-side rail 10 of FIG. 1*c,* travels through wheels 6 and axle 8 of locomotive 2 and returns to its source in an opposite direction in the other rail 10, shown by the dot (•) in the right-side rail of FIG. 1*c*. While the cab signal carrier transmitted in rails 10 shown in FIG. 1*c* is illustrated using the cross and dot conventions, it is to be appreciated that the cab signal carrier is an AC signal, not a DC signal.

Figure 3A:
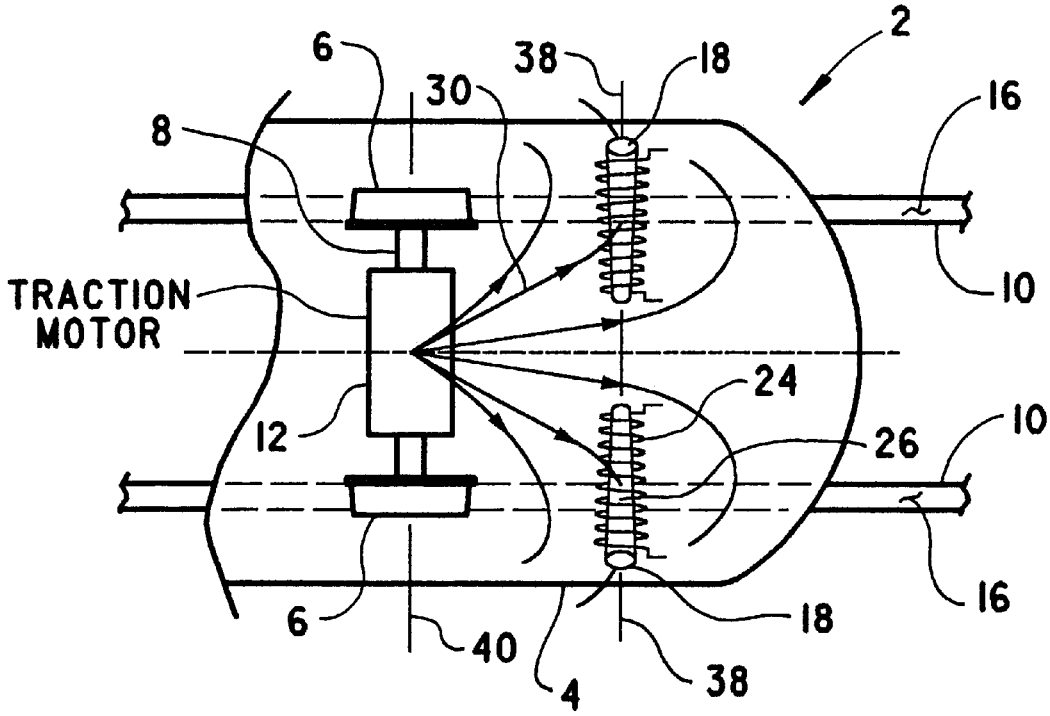
FIGS. 3*a*–3*c* are fragmentary top, side and front views of the locomotive, lead wheels and traction motor shown in FIGS. 1*a*–1*c* with the inductive track receivers positioned in accordance with one embodiment of the present invention.
Figure 3B:
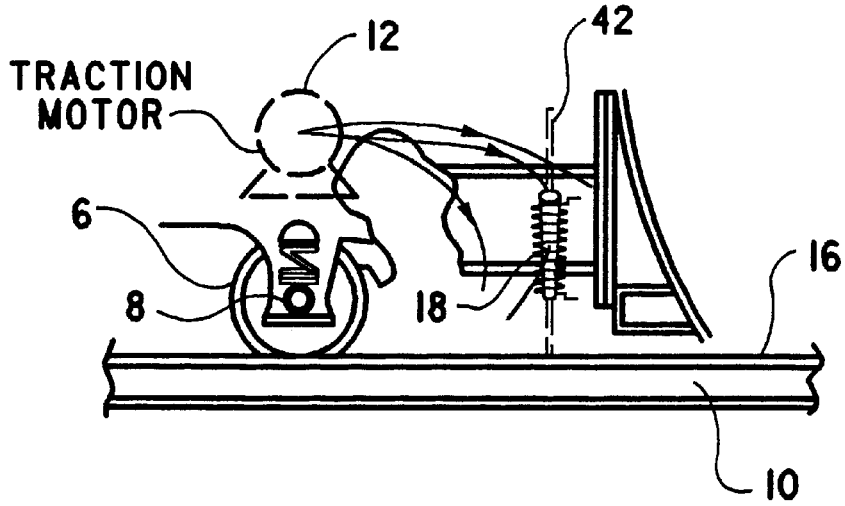
Figure 3C:
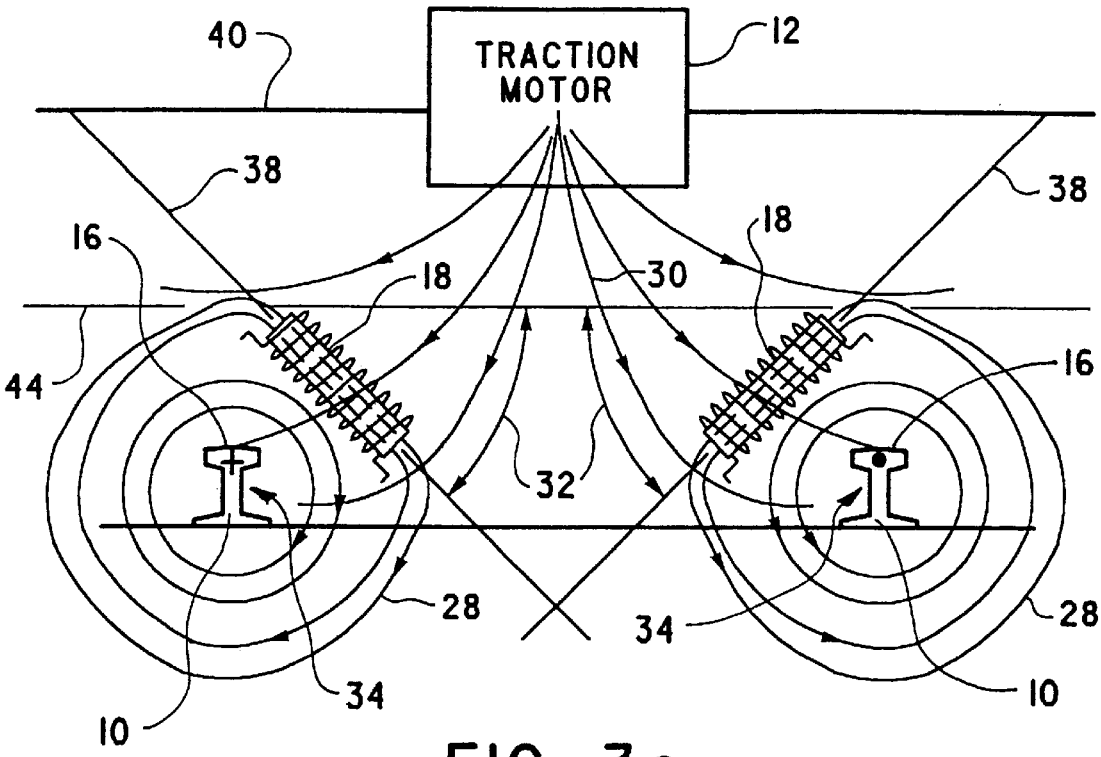

With reference to FIGS. 3*a*–3*c* and with continuing reference to all previous FIGS., before describing the present invention it should be appreciated that traction motor 12 generates a magnetic field vector 30 in a three dimensional space around traction motor 12. At each point in this three dimensional space, magnetic field vector 30 includes, with reference to a Cartesian coordinate system, a horizontal component which extends parallel to the longitudinal axes of rails 10, a lateral component which extends laterally to the longitudinal axes of rails 10 and a vertical component which extends perpendicular to the horizontal and lateral components. Depending on the point in the three dimensional space, however, one or two of these vectors can have a magnitude of zero (0).

Locomotive 2 includes vehicle body 4, wheels 6, axles 8, traction motor 12, power generating means 14 and inductive track receivers 18. In the embodiment shown in FIGS. 3*a*–3*c,* the longitudinal axes 38 of track receivers 18 are received in a first imaginary plane 42 which extends laterally and perpendicular to the longitudinal axes of rails 10 and each track receiver 18 is positioned in first imaginary plane 42 at an angle 32, shown best in FIG. 3*c,* relative to a second imaginary plane 44 which extends parallel to top surfaces 16 of rails 10 adjacent locomotive 2.

With specific reference to FIG. 3*c,* track receivers 18 are oriented so that extensions of longitudinal axes 38 of track receivers 18 from the ends thereof which are closest together cross between rails 10. Moreover, when viewed normal to a surface of first imaginary plane 42, an extension of longitudinal axis 38 of each track receiver 18 crosses an extension of the longitudinal axis 40 of traction motor 12 on a side of rail 10 adjacent track receiver 18 opposite the other rail 10. Stated differently, when viewed normal to a surface of first imaginary plane 42, extensions of longitudinal axes 38 of track receivers 18 from the ends thereof which are farthest apart cross the extension of the longitudinal axis 40 of traction motor 12 outside rails 10. In addition to orienting track receivers 18 with longitudinal axes 38 at angle 32, track receivers 18 are positioned somewhat toward the insides 34 of their respected rails 10.

The orientation of each track receiver 18 shown in FIGS. 3*a*–3*c* is selected so that at the points in the three dimensional space where each track receiver 18 is positioned, longitudinal axis 38 of each track receiver 18 is substantially perpendicular to the horizontal component of magnetic field vector 30, substantially perpendicular to the sum of the vertical and lateral components of magnetic field vector 30 and substantially parallel to magnetic field vector 28 produced around rail 10. In this position and orientation, it has been observed that a noise signal generated by each track receiver 18 in response to receiving magnetic field vector 30 has an amplitude that does not interfere with cab signal system 20 extracting data from the cab signal. More specifically, the sum of the noise signals generated by track receivers 18 does not interfere with cab signal system 20 extracting data from the sum of the cab signals produced by track receivers 18.

Figure 4A:
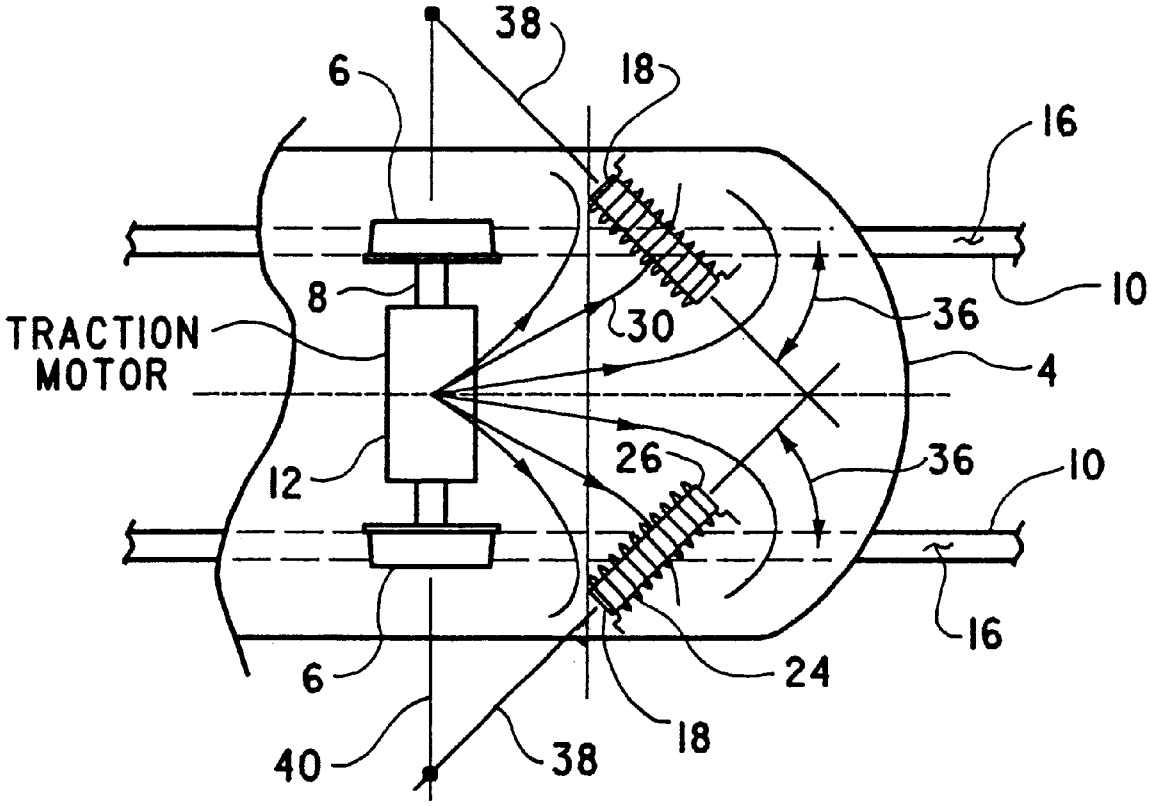
FIGS. 4*a*–4*c* are fragmentary top, side and front views of the locomotive, lead wheels and traction motor shown in FIGS. 1*a*–1*c* with the inductive track receivers positioned in accordance with another embodiment of the invention.
Figure 4B:
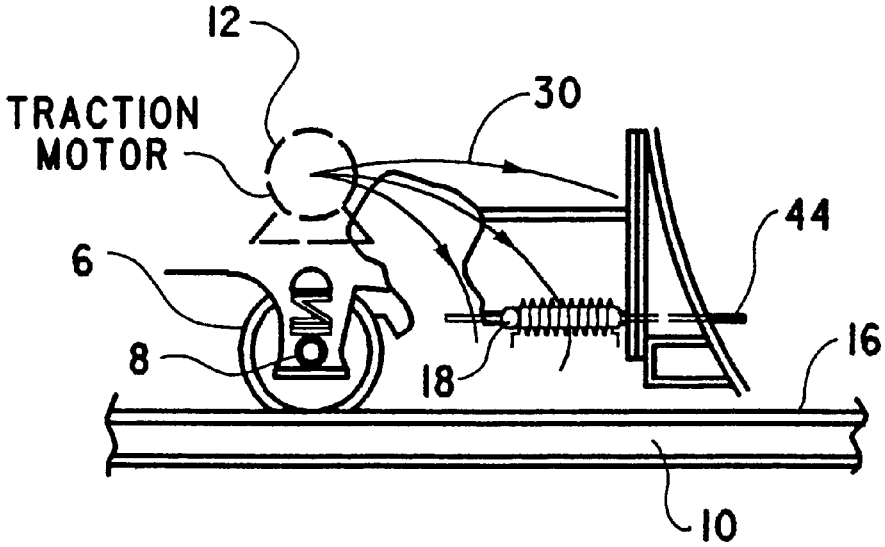
Figure 4C:
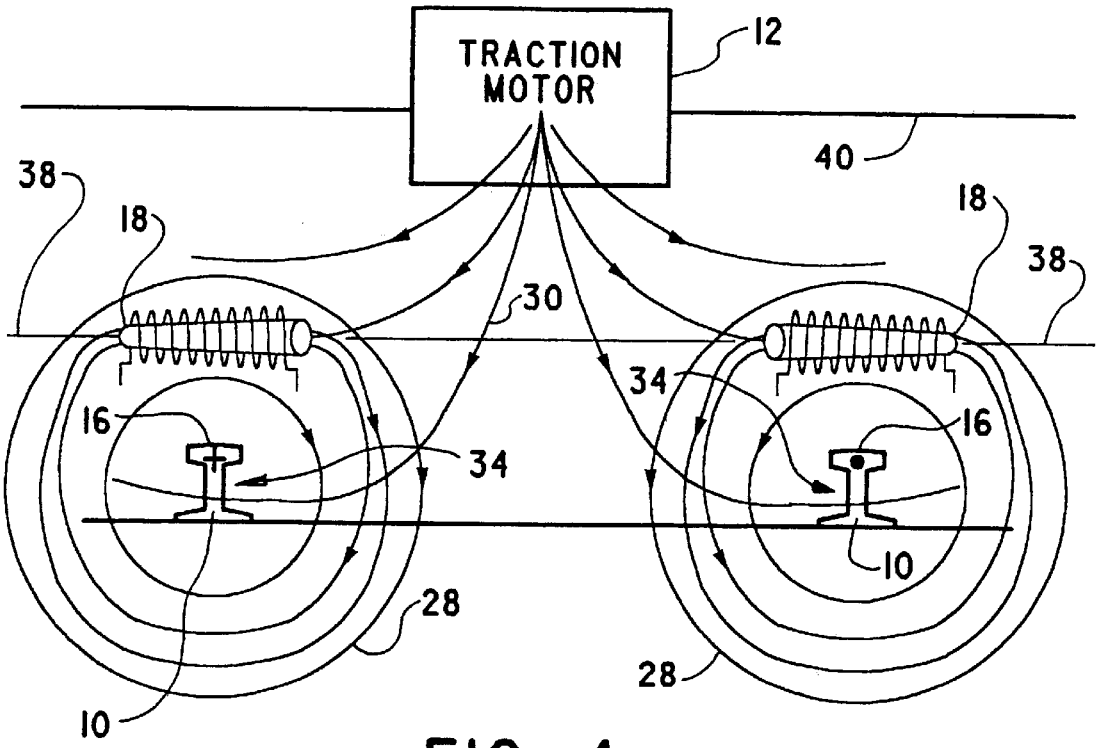

With reference now to FIGS. 4*a*–4*c,* another embodiment of the present invention includes locomotive 2 having vehicle body 4, wheels 6, axles 8, traction motor 12, power generation means 14 and track receivers 18. In this embodiment, however, track receivers 18 are positioned above rails 10 with longitudinal axes 38 received in second imaginary plane 44 and with longitudinal axis 38 of each track receiver 18 oriented at an angle 36 relative to the longitudinal axis of its respective, adjacent rail 10, shown best in FIG. 4*a*.

As shown in FIG. 4*a,* track receivers 18 are oriented so that extensions of longitudinal axes 38 of track receivers 18 from the ends thereof which are closest together cross between rails 10. Moreover, when viewed normal to a surface of second imaginary plane 44, an extension of the axis 38 of each track receiver 18 crosses an extension of the longitudinal axis 40 of traction motor 12 on a side of rail 10 adjacent track receiver 18 opposite the other rail 10. Stated differently, when viewed normal to a surface of second imaginary plane 44, extensions of the longitudinal axes 38 of track receivers 18 from the ends thereof which are farthest apart cross the extension of the longitudinal axis 40 of traction motor 12 outside rails 10.

The orientation of each track receiver 18 in FIGS. 4*a*–4*c* is selected so at the points in the three dimensional space where each track receiver 18 is positioned, longitudinal axis 38 of each track receiver 18 is substantially perpendicular to the vertical component of magnetic field vector 30 and is substantially perpendicular to the vector sum of the horizontal and lateral components of magnetic field vector 30.

Since longitudinal axis 38 of each track receiver 18 is positioned at angle 36 relative to the longitudinal axis of rail 10 adjacent track receiver 18, longitudinal axis 38 of each track receiver 18 is not substantially parallel to magnetic field vector 28 surrounding its respective, adjacent rail 10. However, orienting each track receiver 18 at angle 36 has little or no effect on its ability to produce cab signals.

In the embodiments shown in FIGS. 3*a*–3*c* and 4*a*–4*c,* track receivers 18 are positioned with longitudinal axes 38 at angles 32 and 36 in first and second imaginary planes 42 and 44, respectively. Each of these orientations reduces the amount of magnetic field vector 30 detected by track receivers 18 and, hence, reduces the amplitude of the noise signals output by track receivers 18 sufficiently to enable cab signal system 20 to extract data from the cab signals without interference. Recall, however, that magnetic field vector 30 extends three dimensionally from traction motor 12. Thus, orienting longitudinal axis 38 of each track receiver 18 at angle 32 in first imaginary plane 40 does not minimize to the extent possible the vertical and lateral components of magnetic field vector 30 that propagate transverse to longitudinal axis 38 of track receiver 18. Similarly, orienting each track receiver 18 at angle 36 in second imaginary plane 44 does not reduce to the extent possible the horizontal and lateral components of magnetic field vector 30 that propagate transverse to longitudinal axis 38 of track receiver 18.

Figure 5A:
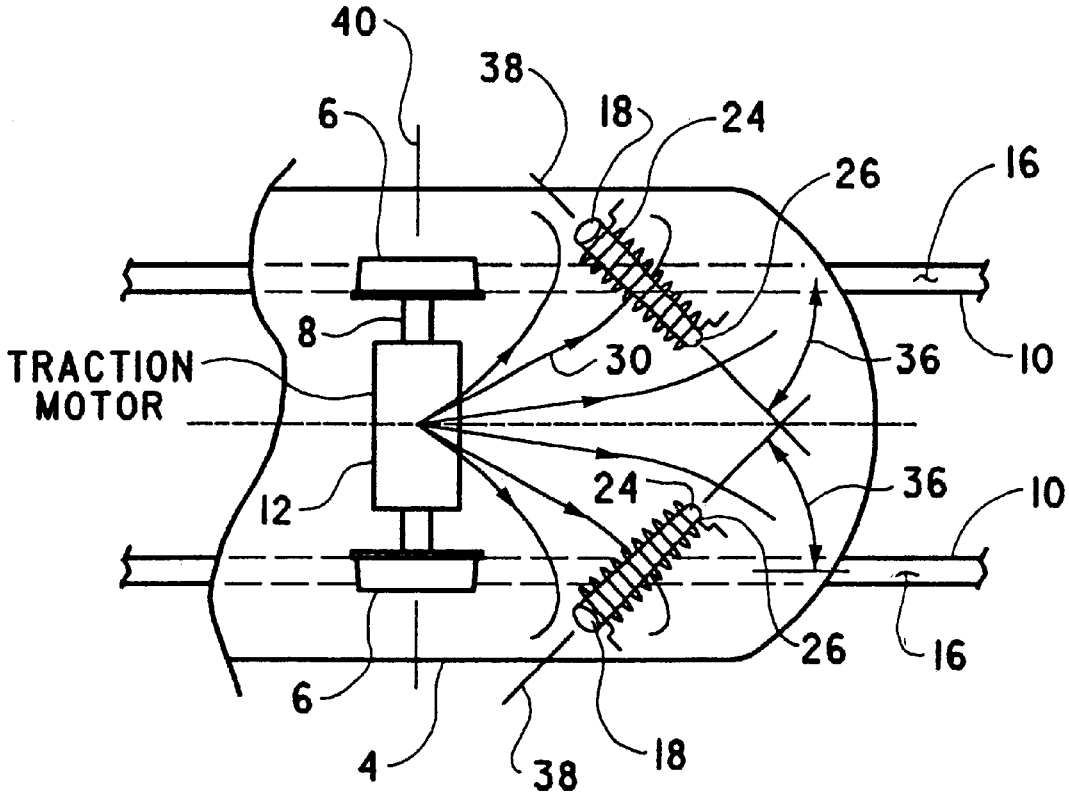
FIGS. 5*a*–5*c* are fragmentary top, side and front views of the locomotive, lead wheels and traction motor of FIGS. 1*a*–1*c* with the inductive track receivers positioned in accordance with yet another embodiment of the present invention.
Figure 5B:
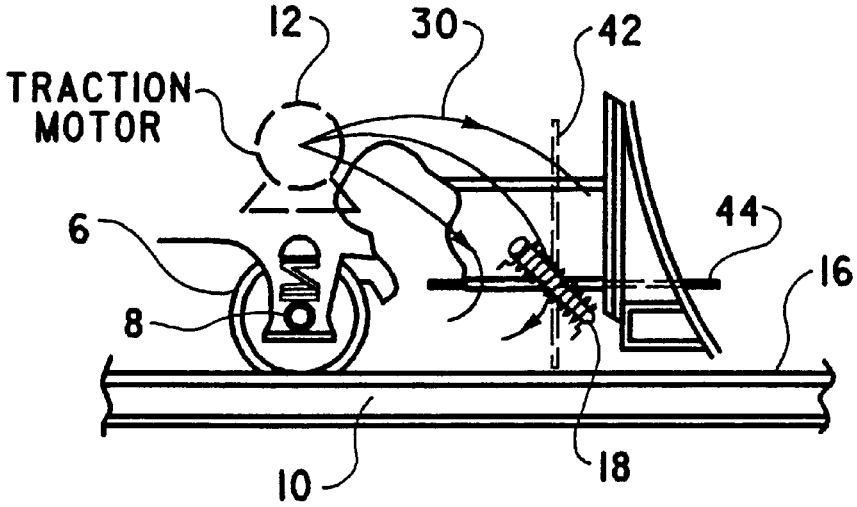
Figure 5C:
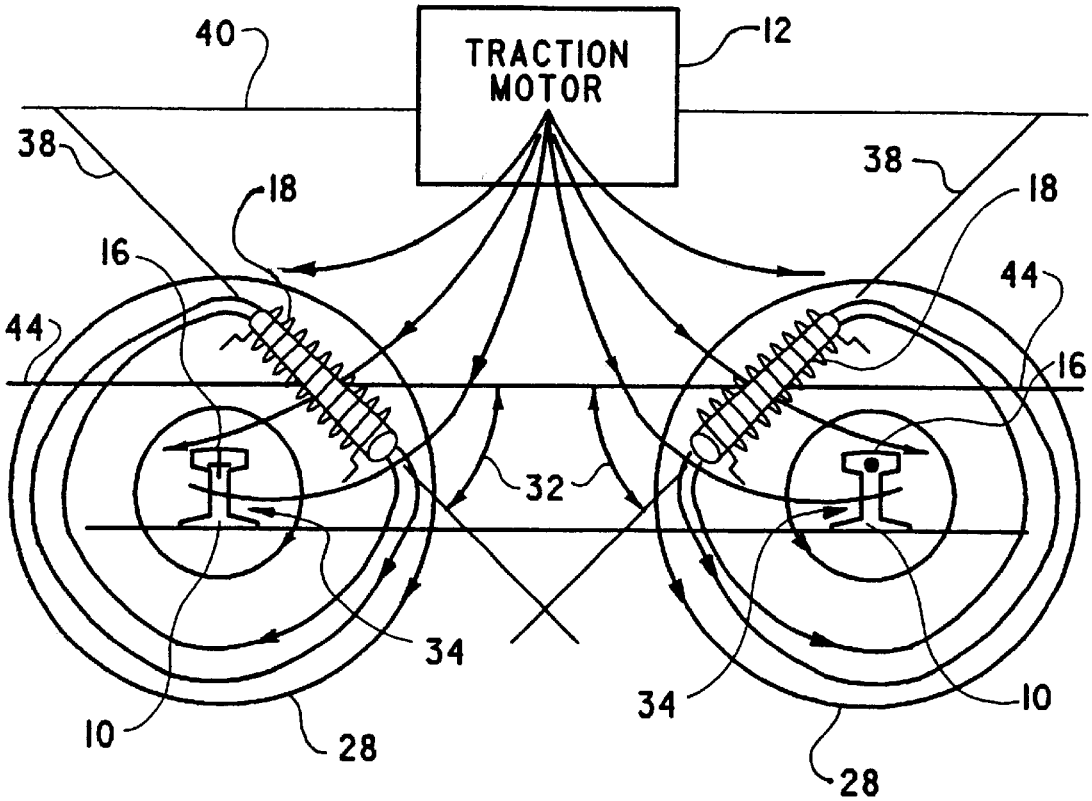

With reference now to FIGS. 5*a*–5*c* and with continuing reference to all previous FIGS., another embodiment of the present invention includes locomotive 2 having vehicle body 4, wheels 6, axles 8, traction motor 12, power generating means 14 and inductive track receivers 18. In this embodiment, however, each track receiver 18 is oriented at the combination of angles 32 and 36, i.e., a compound angle. Orienting each track receiver 18 at this compound angle minimizes the magnetic field vector 30 that propagates along with the longitudinal axes 38 of track receivers 18. Stated differently, by simply orienting each track receiver 18 at this compound angle, the vector sum of the vertical, horizontal and lateral components of magnetic field vector 30 propagates through track receivers 18 substantially perpendicular to the longitudinal axes 38 of track receivers 18. Orienting track receivers 18 at this compound angle thus maximizes the ratio of the cab signals to the noise signals.

It was theoretically determined that for track receivers 18 spaced 50 inches apart between rails 10, with the center of each track receiver 18 positioned approximately 79 inches from the center of traction motor 12, and with the centers of track receivers 18 spaced 21.5 inches below the center of traction motor 12, orienting each track receiver 18 with angle 32 equal to 49.3° and/or with angle 36 equal to 32.3° would reduce the noise signals received by cab signal system 20 sufficiently to permit cab signal system 20 to process the cab signals without interference from the noise signals. For this position of track receivers 18 relative to rails 10 and traction motor 12, it was empirically determined that angle 32 between 40°–60°, preferably between 45°–55°, and/or angle 36 between 25°–40°, preferably between 30°–35°, reduced the noise signals received by cab signaling receiver 20 sufficiently.

As can be seen, simply orienting each track receiver 18 so that the vector sum of at least two of the vertical, horizontal and lateral components of magnetic field vector 30 is substantially perpendicular to longitudinal axis 38 of track receiver 18 reduces the effect of magnetic field vector 30 on track receiver 18 sufficiently so that cab signal system 20 can readily extract data from the cab signals without interference from the noise signals. Moreover, orienting each track receiver 18 in this manner has little or no effect on track receiver 18 receiving magnetic field vector 28.

The present invention has been described with reference to the preferred embodiments. Obvious modifications and alterations will occur to others upon reading and understanding the preceding detailed description. For example, it is to be appreciated that the above described theoretical and experimental results are not to be construed as limiting the invention. Specifically, changing the distance between the center of each track receiver 18 and the center of traction motor 12, changing the spacing between track receivers 18, and the like, may affect one or both of angles 32 and 36 that each track receiver 18 must be oriented in order to minimize the noise signal produced in response to magnetic field vector 30 generated by traction motor 12 during operation. Moreover, while the present invention is most useful when used in combination with locomotive 2 having an AC traction motor, the present invention can also be utilized with a locomotive 2 having a DC traction motor to reduce noise signals produced by track receivers 18 during operation thereof. Furthermore, one track receiver 18 positioned between a pair of rails 10 on which locomotive 2 is carried can be utilized. Lastly, each track receiver 18 can be the inductive coil of wire 24 formed around an air core. It is intended that the invention be construed as including all such modifications and alterations insofar as they come within the scope of the appended claims or the equivalents thereof.

I claim:

1. A system for use on a locomotive having a traction motor which generates a first magnetic field during operation, the system comprising:

a track receiver having a coil of wire wrapped around a core that has a longitudinal axis that defines an axis of sensitivity where the track receiver is most sensitive to magnetic fields propagating therealong, the track receiver located on-board the locomotive and disposed in a second magnetic field produced around at least one of a pair of rails on which the locomotive is carried in response to a cab signal carrier propagating through the at least one rail, for converting the second magnetic field into a cab signal, the track receiver also disposed in the first magnetic field generated during operation of the traction motor of the locomotive for converting the first magnetic field into a noise signal; and a cab signal system located on-board the locomotive and connected to receive the cab signal and the noise signal from the track receiver, the cab signal system configured to extract data from the cab signal which has a frequency range at least partially in common with a frequency range of the noise signal, wherein:

the first magnetic field propagates in a three dimensional space around the traction motor and the first magnetic field has at each point in the three dimensional space a magnetic vector which, with reference to a Cartesian coordinate system, is comprised of a horizontal component which extends parallel to the longitudinal axes of the rails adjacent the locomotive, a lateral component which extends laterally to the longitudinal axes of the rails adjacent the locomotive and a vertical component which extends perpendicular to the horizontal and lateral vectors;

the track receiver is oriented in the first magnetic field so that at the points in the three dimensional space where the track receiver is positioned a vector sum of at least two of the horizontal, lateral and vertical components of the first magnetic field has a direction vector that propagates through the track receiver substantially perpendicular to the axis of sensitivity of the track receiver; and the track receiver is oriented in the second magnetic field so that a direction vector of the second magnetic field produced around the at least one rail propagates through the track receiver substantially parallel to the axis of sensitivity thereof.

2. The system as set forth in claim 1, wherein the axis of sensitivity of the track receiver is received in an imaginary plane which extends substantially parallel to top surfaces of the rails.

3. The system as set forth in claim 2, wherein:

the traction motor has a longitudinal axis which extends transverse to the longitudinal axes of the rails;

the track receiver is positioned adjacent one of the rails; and when viewed normal to a surface of the imaginary plane, an extension of the axis of sensitivity of the track receiver crosses an extension of the longitudinal axis of the traction motor on a side of the one rail opposite the other rail.

4. The system as set forth in claim 3, wherein the longitudinal axis of the traction motor extends laterally to the longitudinal axes of the rails.

5. The system as set forth in claim 1, wherein the track receiver is oriented so that the vector sum of the vertical, horizontal and lateral components has a direction vector that propagates through the track receiver substantially perpendicular to the axis of sensitivity of the track receiver.

6. The system as set forth in claim 1, wherein at least one of the vertical, horizontal and lateral components has a magnitude of zero (0).

7. The system as set forth in claim 1, wherein the track receiver is comprised of (i) a coil of wire or (ii) a Hall effect sensor.

8. The system as set forth in claim 1, wherein the axis of sensitivity of the track receiver is received in a imaginary plane which extends laterally and substantially perpendicular to the longitudinal axes of the rails.

9. The system as set forth in claim 8, wherein the traction motor has a longitudinal axis which extends transverse to the longitudinal axes of the rails;

the track receiver is positioned adjacent one of the rails; and when viewed normal to a surface of the imaginary plane, an extension of the axis of sensitivity of the track receiver crosses an extension of the longitudinal axis of the traction motor on a side of the one rail opposite the other rail.

10. The system as set forth in claim 9, wherein the longitudinal axis of the traction motor extends laterally to the longitudinal axes of the rails.

11. A system for use on a rail vehicle received on a pair of rails and having a traction motor which generates a first magnetic field which propagates in a three dimensional space around the traction motor, the first magnetic field having at each point in the three dimensional space a magnetic vector which, with reference to a Cartesian coordinate system in the three dimensional space, is comprised of the vector sum of three components which extend perpendicular to each other, with one of the three perpendicular components parallel to the longitudinal axes of the rails, the system comprising:

a track receiver positioned on-board the rail vehicle in the three dimensional space adjacent one of the rails and oriented in the three dimensional space so that at the points in the three dimensional space where the track receiver is positioned the vector sum of at least two of the three perpendicular components has a direction vector that propagates through the track receiver substantially perpendicular to an axis of sensitivity of the track receiver where the track receiver is most sensitive to magnetic fields propagating therealong, the track receiver oriented so that a direction vector of a second magnetic field produced around the one rail in response to a cab signal carrier flowing therethrough propagates through the track receiver substantially parallel to the axis of sensitivity of the track receiver; and another track receiver positioned on-board the rail vehicle in the three dimensional space adjacent the other rail and oriented in the three dimensional space so at points in the three dimensional space where the other track receiver is positioned the vector sum of at least two of the three perpendicular components has a direction vector that propagates through the other track receiver substantially perpendicular to an axis of sensitivity of the other track receiver where the other track receiver is most sensitive to magnetic fields propagating therealong, the other track receiver oriented so that a direction vector of a third magnetic field produced around the other rail in response to the cab signal carrier flowing therethrough propagates through the other track receiver substantially parallel to the axis of sensitivity of the other track receiver.

12. The system as set forth in claim 11, wherein the axis of sensitivity of each track receiver is positioned at a compound angle comprising a first angle relative to a first plane which extends parallel to top surfaces of the rails and a second angle relative to a second plane which extends laterally and perpendicular to the longitudinal axes of the rails.

13. The system as set forth in claim 11, wherein the track receivers are connected so that cab signals output by the track receivers in response to a cab signal carrier flowing through the rail adjacent each track receiver are additive.

14. A cab signaling system for use on a locomotive having a traction motor positioned between a front end and a back end of the locomotive, the system comprising:

a first track receiver having a coil of wire wrapped around a core that has a longitudinal axis that defines an axis of sensitivity where the first track receiver is most sensitive to magnetic fields propagating therealong, the first track receiver disposed on-board the locomotive adjacent one of a plurality of rails which support the locomotive and in a first magnetic field generated during operation of the traction motor of the locomotive, the first track receiver outputting a first cab signal in response to a cab signal carrier transmitted through the rail adjacent the first track receiver, the first track receiver outputting in response to the first magnetic field a first noise signal having a frequency in a frequency range of the first cab signal, the first track receiver having its axis of sensitivity oriented at a first position in the first magnetic field substantially perpendicular to a direction vector of the first magnetic field that occurs at the first position and which is oriented substantially parallel to a direction vector of a second magnetic field produced around the rail in response to transmission of the cab signal carrier therethrough; and a signal processor located on-board the locomotive and responsive to the first cab signal and the first noise signal, wherein the orientation of the axis of sensitivity of the first track receiver in the first and second magnetic fields results in a ratio of the first cab signal to the first noise signal being of a sufficient extent so that the signal processor can process the first cab signal without interference by the first noise signal.

15. The system as set forth in claim 14, further including:

a second track receiver having a coil of wire wrapped around a core that has a longitudinal axis that defines an axis of sensitivity where the second track receiver is most sensitive to magnetic fields propagating therealong, the second track receiver disposed on-board the locomotive adjacent another one of the plurality of rails and in the first magnetic field, the second track receiver outputting a second cab signal in response to transmission of the cab signal carrier through the rail adjacent the second track receiver, the second track receiver outputting in response to the first magnetic field a second noise signal having a frequency in a frequency range of the second cab signal, the second track receiver having its axis of sensitivity oriented at a second position in the first magnetic field substantially perpendicular to a direction vector of the first magnetic field that occurs at the second position and which is oriented substantially parallel to a direction vector of a third magnetic field produced around the other rail in response to transmission of the cab signal carrier therethrough, wherein:

the signal processor is responsive to the second cab signal and the second noise signal; and the orientation of the axis of sensitivity of the second track receiver in the first and third magnetic fields results in a ratio of the second cab signal to the second noise signal being of a sufficient extent so that the signal processor can process the second cab signal without interference by the second noise signal.

16. The system as set forth in claim 15, wherein:

the first and second track receivers are connected so that the first and second cab signals sum and the first and second noise signals sum; and the orientation of the axis of sensitivity of the first and second track receivers in the magnetic field results in a ratio of the sum of the cab signals to the sum of the noise signals being of a sufficient extent so that the signal processor can process the sum of the cab signals without interference by the sum of the noise signals.

* * * * *